US006843039B1

(12) United States Patent
Hanmer

(10) Patent No.: US 6,843,039 B1
(45) Date of Patent: Jan. 18, 2005

(54) VACUUM PACKAGING OF ARTICLES

(75) Inventor: James Hanmer, Preston (GB)

(73) Assignee: BAE Systems plc, Farnborough (GB)

( * ) Notice: Subject to any disclaimer, the term of this patent is extended or adjusted under 35 U.S.C. 154(b) by 0 days.

(21) Appl. No.: 09/517,089

(22) Filed: Mar. 6, 2000

(30) Foreign Application Priority Data

Mar. 8, 1999 (GB) ..... 9905214

(51) Int. Cl.[7] ..... B65B 11/52

(52) U.S. Cl. ..... 53/427; 53/432; 53/141; 53/509

(58) Field of Search ..... 53/427, 432, 141, 53/509, 52, 511

(56) References Cited

U.S. PATENT DOCUMENTS

| | | | | | |
|---|---|---|---|---|---|
| 2,828,799 | A | * | 4/1958 | Harrison | |
| 3,279,144 | A | | 10/1966 | Larson | |
| 3,380,583 | A | | 4/1968 | Goodman | |
| 3,648,428 | A | * | 3/1972 | Colburn | |
| 3,828,520 | A | * | 8/1974 | Merritt | |
| 3,848,393 | A | * | 11/1974 | Monoghan | 53/141 |
| 3,861,529 | A | * | 1/1975 | Coleman | |
| 4,062,449 | A | * | 12/1977 | Popkes et al. | |
| 4,133,163 | A | * | 1/1979 | Wilson | 53/141 |
| 4,145,863 | A | | 3/1979 | Hannon | |

FOREIGN PATENT DOCUMENTS

| | | |
|---|---|---|
| DE | 2402977 | 7/1975 |
| DE | 2622625 | 12/1977 |
| FR | 2730211 | 8/1996 |
| GB | 1038207 | 8/1966 |
| WO | WO 93/24374 | 12/1993 |
| WO | WO 98/32674 | 7/1998 |

* cited by examiner

*Primary Examiner*—Rinaldi L. Rada
*Assistant Examiner*—Sameh Tawfik
(74) *Attorney, Agent, or Firm*—Nixon & Vanderhye P.C.

(57) ABSTRACT

A method for the vacuum packaging of articles including at least the steps of:

creating a plurality of recesses in a backing board;

positioning at least one article on said backing board;

placing a film substantially over said at least one article; and using a vacuum packaging machine to substantially package said at least one article, said at least one article being situated between the backing board and the film, wherein the thickness of the backing board is at least 2 mm.

Also a packaged article, the article being packaged between a backing board and a film, wherein the backing board has a thickness of at least 2 mm and the backing board further has a plurality of recesses therein.

13 Claims, 5 Drawing Sheets

VACUUM PACKAGING OF ARTICLES

BACKGROUND OF THE INVENTION

1. Field of the Invention

This invention relates to the general field of vacuum packaging and particularly but not exclusively to the vacuum packaging of components for use in assemblies.

2. Discussion of Prior Art

It is known in various industries, and in particular those light industries involving small consumer goods, to vacuum package articles. These articles are generally of a small, relatively light nature and may be vacuum packaged to help protect them from scratches, cracks or other damage during transit or to prevent oxidisation. Examples of such goods are small screwdrivers, drill bits and batteries. These goods are generally packaged so that they are situated in a viewable position between a transparent plastics film and a thin cardboard backing part. The goods may be removed relatively easily from the packaging by pressing the goods through the thin cardboard backing part.

In heavy industries involving the packaging of larger heavier articles, such as components for assembly, it has been traditional to pack the components into boxes, cases or crates filled with a soft packaging material to prevent damage in transit when the components are moved from one workshop or factory to another for assembly. In industries, for example the aerospace industry, where it is important that certain components are not subjected to even small scratches, the packaging of components has traditionally been a labor intensive and time consuming task, the packaged components also taking up relatively large amounts of space. To counter these problems associated with traditional packaging methods, some heavy industries have attempted to use the vacuum packaging methods employed by light industry. However it was found that the thin cardboard backing parts used for vacuum packaging light consumer goods were not suitable for packaging the heavier components for transporting them to assembly lines.

When vacuum packaged using the thin cardboard backing, heavier components caused the backing part to bend and distort, making it extremely difficult to transport the packaged components. Also the backing part was prone to split or rupture due to those distortions, resulting in damaged components.

To prevent damage to the components, attempts were then made to use thicker backing parts in the vacuum packaging process, but these attempts have generally failed as conventional vacuum packaging machines do not generate enough suction to allow a relatively thick backing plate to be positioned between the vacuum packaging machine and the component to be vacuum packaged.

Consequently heavy industry has had either to rely on traditional methods of packaging as described above, or to vacuum package components using a thin cardboard backing part and then glue the thin backing part on to a rigid backing board so that the components may be transported. This latter method of packaging is not a significant improvement over the traditional methods as the process is still time consuming due to the necessity of having to glue two backing parts together and wait for the glue to fix. Furthermore it is difficult to remove components packaged in this way as a component generally cannot be pushed through the backing part due to the rigid backing board. It is usually necessary to cut the component out via the transparent plastics cover, which has the disadvantages of risks to personnel involved in cutting out the component, and also the risk of scratching the component as it is being cut out. The risk of scratching the component is considerable as the transparent plastics cover has been tightly wrapped around the components, due to the vacuum packaging technique. In applications such as the aerospace industry, it is highly undesirable to use this method as any slight scratches may result in a structural weakness and render a component unusable.

SUMMARY OF THE INVENTION

The present invention seeks to provide an improved method for the vacuum packaging of articles, particularly but not exclusively for packaging a plurality of components to be used in the assembly or part assembly of a larger article.

According to the present invention there is provided a method for the vacuum packaging of articles including at least the steps of:

creating a plurality of recesses in a backing board;

positioning at least one article on the backing board;

placing a film substantially over said at least one article; and using a vacuum packaging machine to substantially package said at least one article, said at least one article being situated between the backing board and the film, wherein the thickness of the backing board is at least 2 mm.

The backing board is advantageously made from cardboard. The cardboard may be formed from layers of paper and the layers may comprise flat and corrugated sheets of paper respectively. Preferably the backing board comprises an odd number of layers of paper, of which an odd number of layers may be flat sheets of paper and an even number of layers may be corrugated sheets of paper. The layers may be arranged alternately to create the backing board. The thickness of the backing board is advantageously at least 5 mm. The thickness of the backing board is preferably in the range of 7.5 mm to 10.5 mm.

Preferably the method further comprises the step of applying a bonding agent to the backing board. The bonding agent is advantageously applied to one face of the backing board and is preferably air dried. The bonding agent is adapted to cause the film to bond with the backing board. The bonding agent is applied to a face of the backing board which is closest to the film, when the film is placed over said at least one article. The bonding agent may be adapted to cause the film to bond with the backing board upon the bonding agent or the film being heated. Said at least one article may comprise one or more components. Preferably the film, when placed, extends substantially around each of said components to touch the backing board at substantially a circuit of points around each of said components. Advantageously on substantially simultaneously heating the film and applying suction to a face of the backing board opposite to said component, the bonding agent causes the film to bond with the backing board around each of said components to substantially seal in each of said components.

Preferably the method comprises the step of preventing the film from bonding with the backing board in a region adjacent to and extending around each of said components, to facilitate removal of the component from the packaging. This prevention step may be achieved by applying the bonding agent to only part of said one face of the backing board. Advantageously, the bonding agent is not applied to a region where a component is to be positioned, said region being greater than a corresponding cross section of said component. Alternatively, this prevention step may be achieved by masking the bonding agent in those regions where it is undesirable that the film bond with the backing board.

Preferably the method further comprises the step of applying an ink to the backing board. The ink is advantageously applied to the said one face of the backing board to which the bonding agent has been applied. The bonding agent is preferably applied and is preferably allowed to dry before the ink is applied. The ink is preferably applied to the areas of the backing board on which components are intended to be placed. The ink is preferably applied to said areas by printing means. Said printing means preferably are adapted to provide said areas of the backing board with the shape of each of said components superimposed in ink thereupon. Said printing means may be silk screen printing.

Advantageously said shape of each of said components is greater in area than a corresponding cross-section of each of said components.

The method may further comprise the step of positioning each of said components on the shape corresponding to those components. This has the advantage of allowing an operator to quickly and accurately position components, using the pre-printed shapes on the backing board.

The method may further comprise the step of taking digital photographs of each of said components. The digital photographs may be adapted to be used to arrange the layout of components on the backing board. Said digital photographs may further be adapted to be used in any printing of shapes of the component on the backing board.

Said plurality of recesses may be created on said backing board by punching holes at least part way into said backing board. Substantially each recess of said plurality of recesses preferably extends into at least one-fifth of the thickness of said backing board. Substantially each recess extends into no further than four-fifths of the thickness of said backing board.

Advantageously said backing board comprises two layers of corrugated sheets of paper and three layers of flat sheets of paper, arranged in alternate layers. In this configuration, said plurality of recesses substantially extend just into a second layer of corrugated paper.

Said plurality of recesses are preferably created on the face of said backing board an which said at least one article is to be positioned. Said plurality of recesses are preferably created after the application of said bonding agent.

Substantially each of said recesses may have a diameter of at least 2 mm. Preferably substantially each of said recesses has a diameter in the range 2.5 mm to 6.0 mm. Alternatively substantially each of said recesses may have a surface area of at least 3 $mm^2$. Preferably each of said recesses has a surface area in the range 5 $mm^2$ to 20 $mm^2$.

Said plurality of recesses are advantageously arranged in a regular pattern on said backing board to have a pitch between recesses in the range 5 mm to 75 mm. Preferably said pitch is in the range 15 mm to 50 mm.

According to the present invention there is further provided a packaged a article, the article being packaged between a backing board and a film, wherein the backing board has a thickness of at least 2 mm and the backing board further has a plurality of recesses therein.

Advantageously, the film is not bonded with the backing board in a region substantially adjacent to and extending around the article, to facilitate removal of the article from the packaging.

Preferably, the backing board further comprises an enlarged shape of the article superimposed thereon.

It will be recognised that several articles may be packaged on to the same backing board as individual components.

The backing board is preferably as described earlier with respect to the method.

BRIEF DESCRIPTION OF THE DRAWINGS

An embodiment of the invention will now be described, by way of example only, and with reference to the following drawings.

DETAILED DISCUSSION OF EMBODIMENTS

Figure 1:
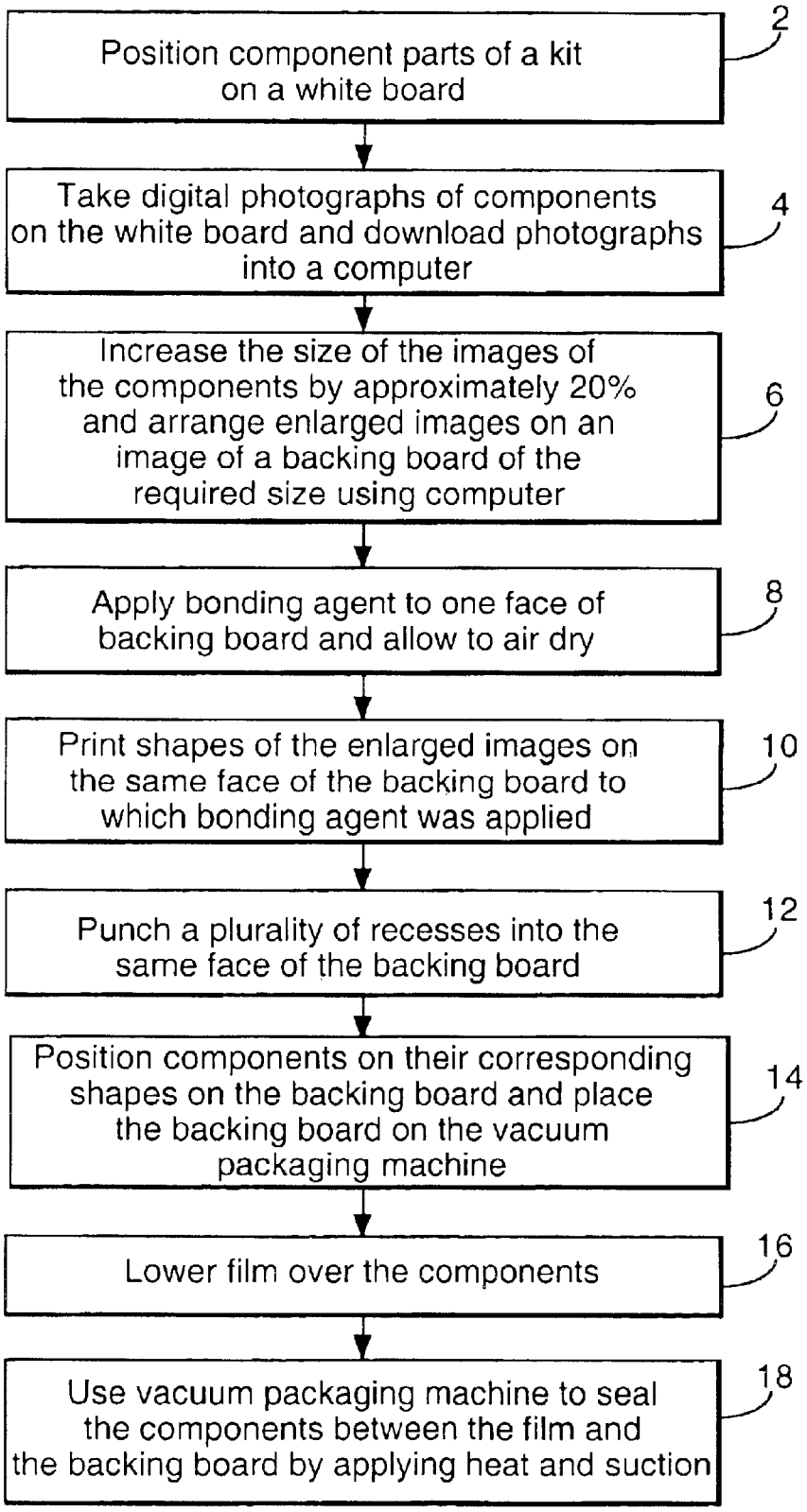
FIG. 1 shows a flow chart of a method in accordance with the present invention.

FIG. 1 shows the sequential steps in a method for vacuum packaging aircraft components. The packaged components may be needed at predetermined times in the assembly of an aircraft or a re-assembly of an aircraft after a major service or update. The parts to be packaged are divided into various assembly kits and each kit is photographed by a digital camera, either as individual components or as a set of components. The components for each kit are laid out on a white board (step 2), the board being of a similar size to a backing board for use with the vacuum packaging machine, and the components are arranged as desired before being photographed (step 4).

The part numbers, aircraft number and other relevant information are written next to the component before the photograph is taken. In this way the digital photograph contains all the information about the size, shape, part number, aircraft number and other important features of each component.

The digital photographs are then downloaded into a computer, where the images may be manipulated. The digital images of the components are blown up to a size of approximately 20% larger than the actual component size (step 6). The enlarged images of the components are then arranged as efficiently as possible on a digital image of a backing board. The backing boards are all the same size and are dimensioned to fit the vacuum packaging machine. The written information relating to each component is also positioned on the digital backing board image. A full size negative print of the arrangement is then printed out, on photographic film.

If any components in the kit are to be changed, that component can simply be taken out of the digital image showing the components arranged on the backing board and a new component may be positioned there.

A layered cardboard backing board, dimensioned to fit a commercially available vacuum packaging machine, is taken and a bonding agent applied over one face (step 8). The bonding agent is preferably glue, such as Adcote 37R929. The bonding agent should be applied evenly over the face, and is preferably applied with a sponge so that not too much bonding agent is applied, as this seals the backing board and prevents the vacuum process from working. The face to which the glue is applied is dependent upon the arrangement of the layers in the backing board. The backing board should then be allowed to air dry, as artificial drying can affect the porosity of the cardboard based backing board, which in turn will impair the vacuum process.

Figure 3A:
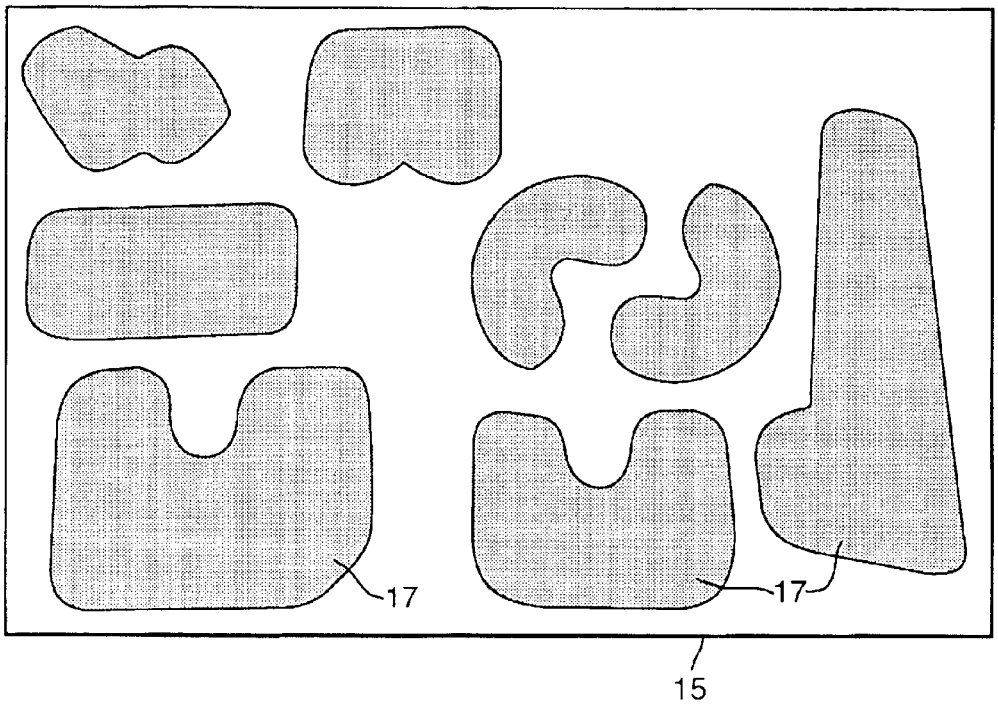
FIG. 3*a* shows a plan view of a backing board according to another aspect of the present invention comprising shapes superimposed in ink thereupon.
Figure 3B:
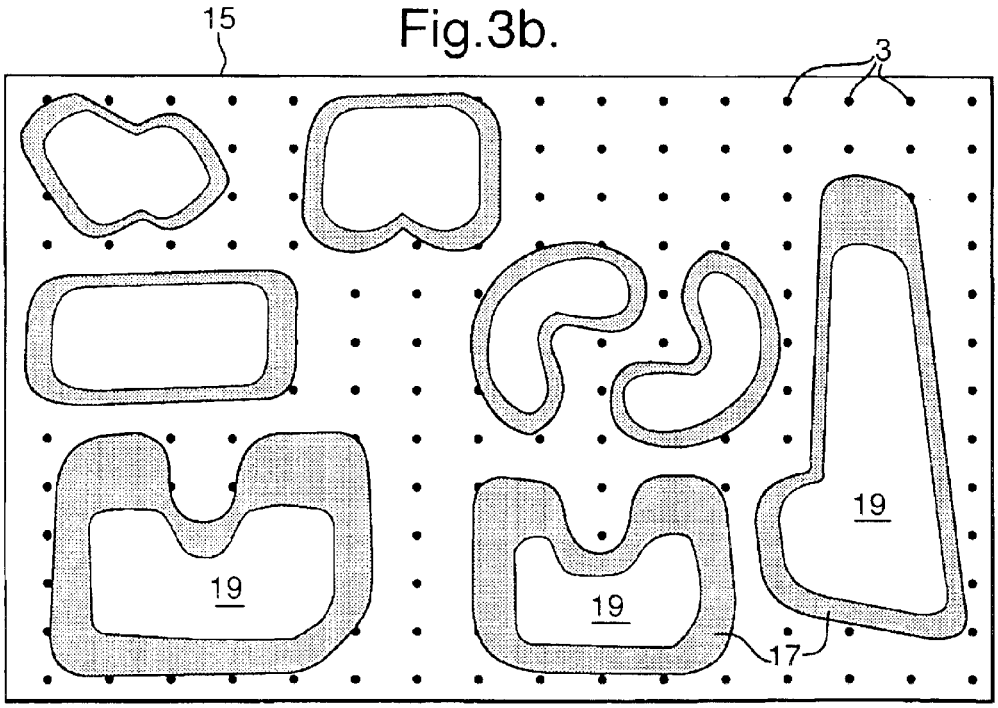
FIG. 3*b* shows a plan view of the backing board of FIG. 3*a* further comprising components positioned on the backing board.

Once dry, the board is ready for the printing process, using silk screen printing (step 10). Emulsion is applied to a silk screen mesh and the negative print of the arrangement of the components is placed over the mesh. The negative print is then exposed to ultra violet radiation, which passes through certain areas of the negative only and hardens the emulsion in these areas. The non-hardened areas of emulsion can be washed away leaving hardened emulsion areas on the mesh in the areas where no component was positioned. The backing board is then held in a standard silk screen frame with the mesh, and regular silk screen printing is then performed using standard silk screen printing ink. The ink is applied to the same face of the backing board as that face to which the bonding agent was applied, to produce a black profile, or mask, of enlarged images of the components as shown in FIG. 3*a*. This allows the components of the kit to be arranged quickly and consistently prior to vacuum packing and allows easy checking that all parts are present, as shown in FIG. 3*b*. The bonding agent should be applied to the backing board before the silk screen printing process, as the application of the ink on top of the bonding agent prevents the bonding agent in those inked areas from substantially causing the film to bond to the backing board.

Figure 2A:
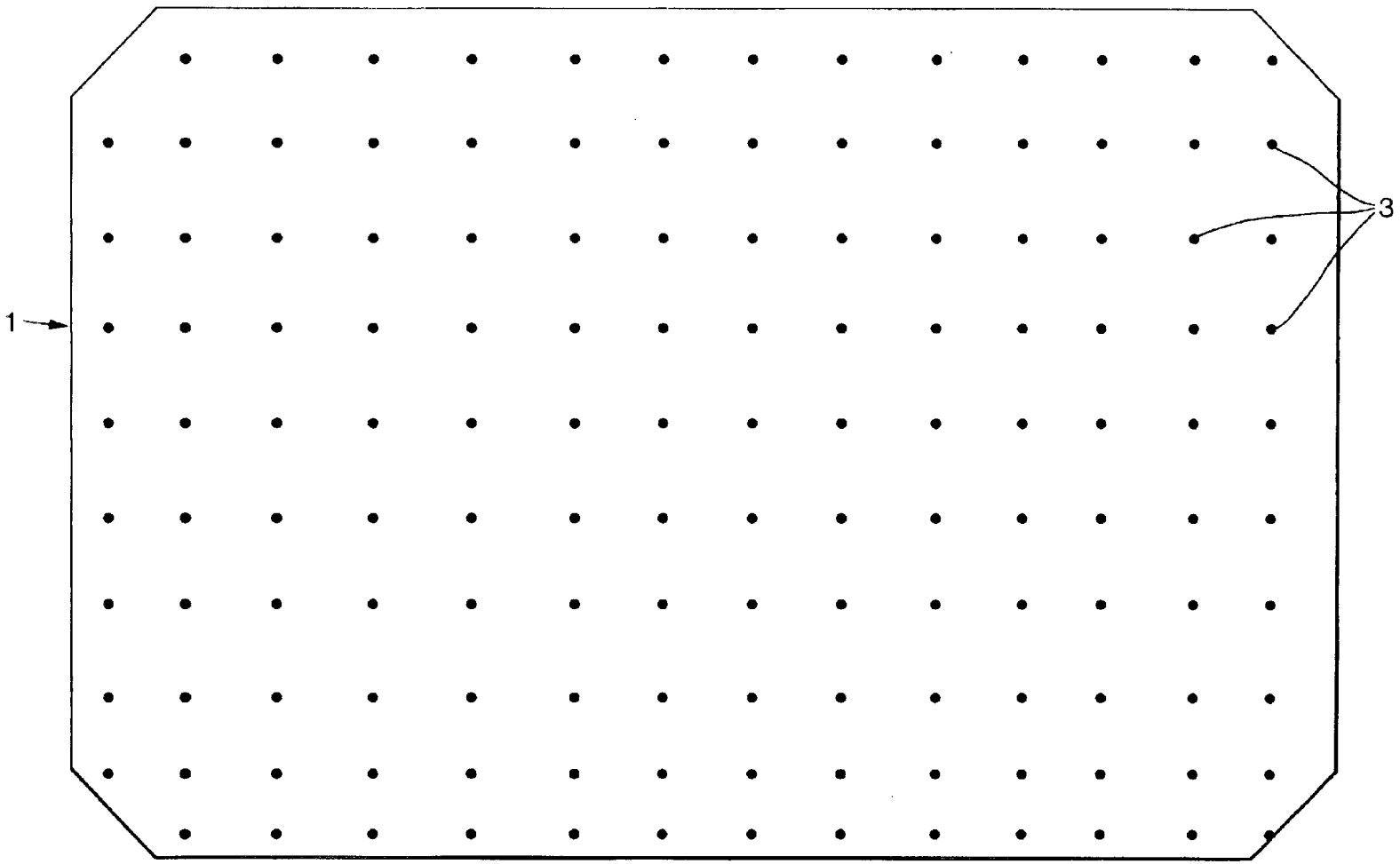
FIG. 2*a* shows a plan view of a backing board comprising a plurality of recesses in accordance with the present invention.
Figure 2B:
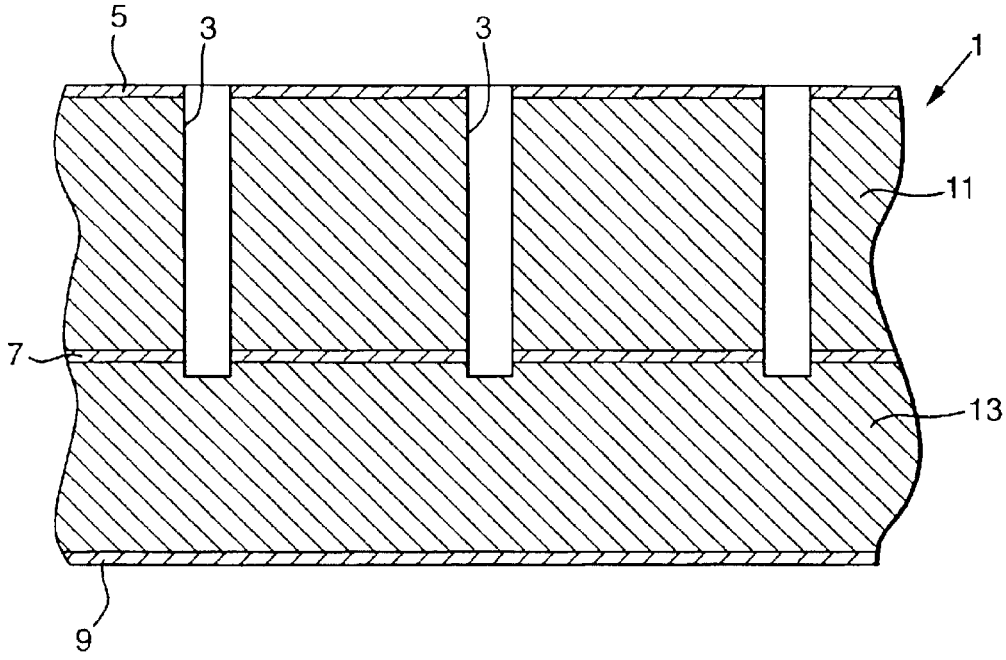
FIG. 2*b* shows a cross-sectional view of a section of the backing board of FIG. 2*a;*

Recesses are then punched into the backing board, the recesses being in the same face of the backing board as that face to which the glue and ink was applied (step 12). The recesses may be of substantially cylindrical shape or of rectangular shape. FIGS. 2*a* and 2*b* show the recesses of this particular embodiment in more detail.

Although the bonding agent should be applied before the ink. It will be recognised that the recesses may be created before or after any of these operations. It is usually preferable to apply the bonding agent before creating the recesses as the bonding agent may fill any recesses when it is applied, and this is undesirable as it reduces the suction effect of the vacuum packaging machine.

When the backing board has had the bonding agent and ink applied to it, and recesses punched into it, the backing board is then placed on the vacuum packaging machine and the components are arranged on their corresponding ink profiles (step 14). A thin plastic film is lowered over the component (step 16), and the machine applies heat to the film and applies a vacuum through the backing board to cause the film to stick to the bonding agent on the backing board at those uninked areas, thus sealing each component between the film and the board (step 18).

The film does not stick to those areas of the backing board to which ink has been applied, and so there is an inked area around each component where the film has not bonded to the backing board. These inked areas assist in the easy removal of components from the vacuum packaging as the film may be cut within these areas without the risk of damaging the component.

Removing one component from the backing board does not affect the integrity of the seal around the remaining components on the backing board, and there is complete visibility of the components removed, and the remaining parts of the kit.

FIG. 2*a* shows a backing board 1 having plurality of recesses 3 punched in a regular rectolinear pattern therein. Each of the recesses 3 has a diameter of 3 mm and the horizontal and vertical pitch between each of the recesses is 30 mm.

FIG. 2*b* shows a partial cross-section through the backing board 1. The thickness of the backing board 1 is approximately 8 mm and the recesses 3 are punched to a depth of approximately 5.5 mm. The backing board 1 is made up from layers of flat paper sheets 5, 7, 9 and of layers of corrugated paper sheets 11, 13 arranged alternately as shown.

Figure 2C:
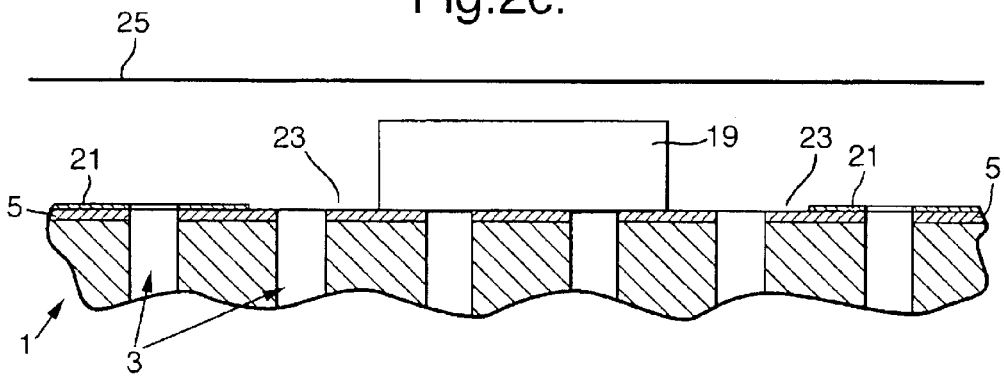
FIG. 2*c* shows a side view of the backing board of FIG. 2*a* in accordance with one aspect of the present invention.

FIG. 2*c* shows part of the backing board 1 having recesses 3 punched into it, and also having a bonding agent 21 applied to part of one face of the backing board 1. The bonding agent 21 was applied before the recesses 3 were punched into the backing board 1.

A component 19 has been placed on to the backing board 1 on a region 23 of the backing board 1 to which no bonding agent 21 has been applied. It will be noted that the region 23 is greater than the cross sectional area of the component 19 and the component 19 is positioned within the region 23 in a manner which enables the component to be surrounded by an area where no bonding agent 21 has been applied. A transparent plastics film 25 is positioned over the component 19 as shown.

Figure 2D:
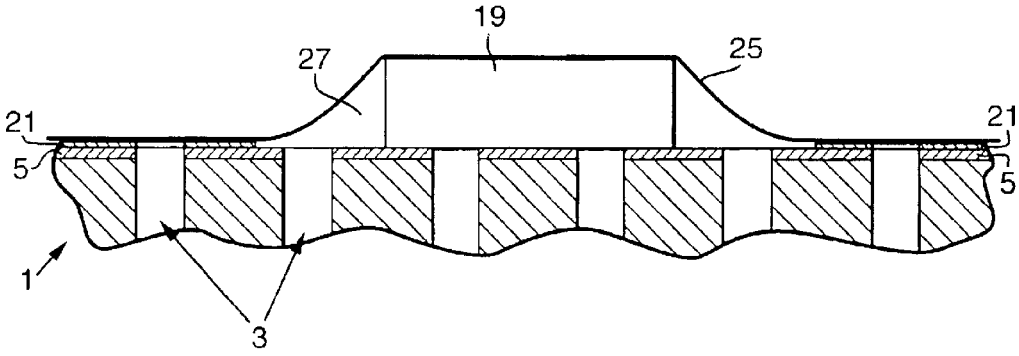
FIG. 2*d* shows the view of FIG. 2*c* when a component has been sealed on to the backing board.

FIG. 2*d* shows part of the backing board 1 after the vacuum packaging machine has been used to seal the component 19 on to the backing board 1. As a vacuum packaging machine (not shown) applies heat to the film 25 and suction to the face of the backing board 1 opposite to layer 5, the film 25 adheres to the backing board 1 in those areas where the bonding agent 21 has been applied. In region 23, where no bonding agent 21 has been applied, the film 25 does not adhere to the backing board. This leaves a volume 27 around the component 19 into which a knife or other sharp object may be inserted through the film 25 in order to cut out the component 19. Ideally the volume 27 is large enough to allow the component 19 to be cut out without a substantial risk of scratching the component 19.

The recesses 3 permit a vacuum packaging machine (not shown) to operate effectively when thicker backing boards (such as those in the range 5 mm to 12 mm) are used.

FIG. 3*a* shows an alternative backing board 15 having shape 17 superimposed in ink thereupon, following the silk screen printing process. Before this printing process, a bonding agent was applied to this same face of the backing board and was allowed to air dry. The recesses 3 of FIG. 2*a* may be punched either before or after the printing process and in this example have not yet been punched into the backing board 15.

FIG. 3*b* shows the backing board 15 of FIG. 3*a* having recesses 3 punched in it. Components 19 have also been placed on to the backing board 15, the components 19 being positioned on the corresponding shape 17. The components 19 are now ready to be vacuum packed on a vacuum packaging machine (not shown). The shapes 17 are larger than toe corresponding components 19, to facilitate easy removal of the components, as the film used in the vacuum packaging process will not readily bond to those inked areas 17.

It will be recognised that the inked areas may alternatively be produced by hand, or may be produced as a standard shape which does not correspond to the profile of each component.

What is claimed is:

1. A method for the vacuum packaging of at least one article including at least the steps of:

creating at least one recess in a backing board;

applying a bonding agent to the backing board but not in a region adjacent to and extending around an area to be occupied by said at least one article;

positioning at least one article on the backing board in said area;

placing a film substantially over the at least one article; and using a vacuum packaging machine to substantially package the at least one article, the at least one article being situated between the backing board and the film, wherein the thickness of the backing board is at least 2 mm.

2. A method in claim 1, wherein the bonding agent is air dried before the film is bonded to the backing board.

3. A method as claimed in claim 1, comprising heating the film to cause the film to bond with the backing board.

4. A method as claimed in claim 1, comprising heating the film and applying suction to a face of the backing board opposite the article(s), substantially simultaneously so that the bonding agent causes the film to bond with the backing board around the or each article to substantially seal in the or each article.

5. A method as claimed in claim 1, wherein the step of preventing the film from bonding with the backing board is achieved by applying the bonding agent to only part of the surface of the backing board.

6. A method as claimed in claim 5, wherein the bonding agent is not applied to a region where an article is to be positioned, said region being greater than a corresponding cross section of the article.

7. A method as claimed in claim 1, wherein the step of preventing the film from bonding with the backing board is achieved by masking the bonding agent in those regions where the film is not to bond with the backing board.

8. A method as claimed in claim 1, comprising applying an ink to the backing board.

9. A method as claimed in claim 1, wherein ink is applied to the surface of the backing board to which bonding agent has been applied, the bonding agent having been allowed to dry before the ink is applied, the ink being applied to the areas of the backing board on which the or each article is intended to be placed.

10. A method as claimed in claim 9, wherein the ink is applied to the backing board by printing means so as to provide the backing board with the shape of the or each article superimposed in ink thereupon, the or each superimposed ink shape being greater in area than a corresponding cross-section of the associated article.

11. A method as claimed in claim 10, wherein digital photography is used in the printing of the shape(s) on the backing board.

12. A method as claimed in claim 1, wherein the recesses are created on the backing board by punching holes at least part way thereinto.

13. A method as claimed in claim 1, wherein the recesses are created before the application of the bonding agent.

* * * * *